US011105116B1

(12) United States Patent
Fisher et al.

(10) Patent No.: US 11,105,116 B1
(45) Date of Patent: Aug. 31, 2021

(54) BOLLARD WALL SYSTEM

(71) Applicant: TGR Construction, Inc., Tempe, AZ (US)

(72) Inventors: Thomas G. Fisher, Dickinson, ND (US); Gregory L. Schafer, Dickinson, ND (US)

(73) Assignee: TGR Construction, Inc., Tempe, AZ (US)

( * ) Notice: Subject to any disclaimer, the term of this patent is extended or adjusted under 35 U.S.C. 154(b) by 0 days.

(21) Appl. No.: 17/205,806

(22) Filed: Mar. 18, 2021

(51) Int. Cl.
*E04H 17/24* (2006.01)
*E04H 17/14* (2006.01)

(52) U.S. Cl.
CPC ..... *E04H 17/24* (2013.01); *E04H 17/1417* (2013.01)

(58) Field of Classification Search
CPC ..... E04H 17/263; E04H 17/22; E04H 17/23; E04H 12/22; E04H 12/2238; E04H 12/2246; E04H 12/2269; E04H 12/2284; E04H 12/2292; E04H 12/347; E01F 15/00; E01F 15/003
See application file for complete search history.

(56) References Cited

U.S. PATENT DOCUMENTS

| | | | |
|---|---|---|---|
| 1,629,899 | A | 5/1927 | Wustholz |
| 1,721,816 | A | 7/1929 | Glazer |
| 1,925,689 | A | 9/1933 | Dietrich |
| 2,049,916 | A | 8/1936 | Lingle |
| 2,164,592 | A | 7/1939 | Pilj |
| 2,172,461 | A | 9/1939 | Whitescarver |
| 2,173,698 | A | 9/1939 | Schenk |
| 2,395,204 | A | 2/1946 | Symons |
| 2,497,887 | A | 2/1950 | Hilpert |
| 2,614,801 | A | 10/1952 | Mazzei |
| 2,659,125 | A | 11/1953 | Williams |
| 2,717,801 | A | 9/1955 | Neil |
| 2,902,311 | A | 9/1959 | Reel |
| 3,163,904 | A | 1/1965 | Ziolkowski |
| 3,209,933 | A | 10/1965 | Barnes |
| 3,220,760 | A | 11/1965 | Buchik |
| 3,298,541 | A | 1/1967 | Alexon |

(Continued)

FOREIGN PATENT DOCUMENTS

| | | | |
|---|---|---|---|
| CA | 2923047 | A1 | 9/2017 |
| DE | 2657111 | A1 | 6/1977 |

(Continued)

OTHER PUBLICATIONS http://www.aluminumconcreteforms.com/crane_set_concrete_forms.htm; Wall-Ties & Forms Concrete Big Panel Concrete Forms Website Page.

(Continued)

*Primary Examiner* — Jonathan P Masinick
(74) *Attorney, Agent, or Firm* — Neustel Law Offices

(57) ABSTRACT

A bollard wall system for efficiently assembling a bollard wall. The bollard wall system generally includes a support structure having a plurality of sleeves adapted to be positioned within a trench filled with concrete, and a plurality of bollards positioned within the plurality of sleeves in a vertical manner. Each of the plurality of bollards are lifted and lowered into a corresponding one of the plurality of sleeves by a crane vehicle to form a bollard wall.

65 Claims, 10 Drawing Sheets

(56) References Cited

U.S. PATENT DOCUMENTS

| | | | |
|---|---|---|---|
| 3,432,041 | A | 3/1969 | van Huet |
| 3,464,667 | A | 9/1969 | Sledz |
| 3,478,396 | A | 11/1969 | Drouillard |
| 3,635,613 | A | 1/1972 | Marsh |
| 3,647,099 | A | 3/1972 | Carriere |
| 3,676,031 | A | 7/1972 | Stinton |
| 3,687,597 | A | 8/1972 | Lavergne, Jr. |
| 3,693,931 | A | 9/1972 | Holt |
| 3,760,966 | A | 9/1973 | Jones, Jr. |
| 3,801,061 | A | 4/1974 | Holt |
| 3,833,706 | A | 9/1974 | Edwards |
| 3,844,697 | A | 10/1974 | Edwards |
| 3,910,546 | A | 10/1975 | Connors |
| 3,926,318 | A | 12/1975 | Kister |
| 3,954,189 | A | 5/1976 | Sherritt |
| 3,965,542 | A | 6/1976 | Gregory |
| 4,003,543 | A | 1/1977 | Doubleday |
| 4,006,878 | A | 2/1977 | Dawson |
| 4,023,771 | A | 5/1977 | Walchek |
| 4,044,986 | A | 8/1977 | Strickland |
| 4,098,045 | A | 7/1978 | Astor |
| 4,158,452 | A | 6/1979 | Gates |
| 4,186,906 | A | 2/1980 | Koga |
| 4,192,481 | A | 3/1980 | Durbin |
| 4,218,039 | A | 8/1980 | Gates |
| 4,221,357 | A | 9/1980 | Bowden |
| 4,231,541 | A | 11/1980 | Strickland |
| 4,254,932 | A | 3/1981 | Durbin |
| 4,290,246 | A | 9/1981 | Hilsey |
| 4,314,775 | A | 2/1982 | Johnson |
| 4,384,739 | A | 5/1983 | Gustavsson |
| 4,405,262 | A | 9/1983 | Nagashima |
| 4,417,425 | A | 11/1983 | Case |
| 4,441,685 | A | 4/1984 | Greeson |
| 4,453,861 | A | 6/1984 | Bretz |
| 4,481,743 | A | 11/1984 | Jellen |
| 4,611,784 | A | 9/1986 | Gallis |
| 4,671,724 | A | 6/1987 | Bolton |
| 4,676,713 | A | 6/1987 | Voelpel |
| 4,700,979 | A | 10/1987 | Courtois |
| 4,708,315 | A | 11/1987 | Carlson |
| 4,726,562 | A | 2/1988 | Courtois |
| 4,795,136 | A | 1/1989 | Haefner |
| 4,807,843 | A | 2/1989 | Courtois |
| 4,812,113 | A | 3/1989 | Jantzen |
| 4,846,433 | A | 7/1989 | Courtois |
| 4,899,978 | A | 2/1990 | Gates |
| 4,924,641 | A | 5/1990 | Gibbar, Jr. |
| 4,927,317 | A | 5/1990 | Acosta |
| 5,038,541 | A | 8/1991 | Gibbar, Jr. |
| 5,050,365 | A | 9/1991 | Edgar |
| 5,073,077 | A | 12/1991 | Attman |
| RE33,881 | E | 4/1992 | Courtois |
| 5,114,294 | A | 5/1992 | Attman |
| 5,127,791 | A | 7/1992 | Attman |
| 5,224,808 | A | 7/1993 | Macris |
| 5,351,456 | A | 10/1994 | Paine, Jr. |
| 5,364,050 | A | 11/1994 | Smith |
| 5,425,213 | A | 6/1995 | Abe |
| 5,441,379 | A | 8/1995 | Gilbert, Jr. |
| 5,537,797 | A | 7/1996 | Harkenrider |
| 5,624,222 | A | 4/1997 | Hiatt |
| 5,643,488 | A | 7/1997 | Lee |
| 5,799,399 | A | 9/1998 | Schultz |
| 5,857,296 | A | 1/1999 | Niday |
| 5,922,236 | A | 7/1999 | Zuhl |
| 5,956,922 | A | 9/1999 | Liuska |
| 6,513,785 | B1 | 2/2003 | Worley |
| 6,523,323 | B2 | 2/2003 | Worley |
| 6,729,079 | B2 | 5/2004 | Francies, III |
| 6,755,385 | B2 | 6/2004 | Lancelot, III |
| 6,935,607 | B2 | 8/2005 | Ward |
| 7,004,443 | B2 | 2/2006 | Bennett |
| 7,051,988 | B2 | 5/2006 | Shaw |
| 7,144,186 | B1 | 12/2006 | Nolte |
| 7,222,460 | B2 | 5/2007 | Francies, III |
| 7,596,923 | B1 * | 10/2009 | Thomas ..... E02D 27/02 52/274 |
| 7,775,500 | B1 | 8/2010 | Vegsund |
| 7,819,388 | B2 | 10/2010 | McCallion |
| 7,828,263 | B2 | 11/2010 | Bennett |
| 7,874,053 | B2 | 1/2011 | Stangel |
| 8,186,645 | B2 | 5/2012 | Shaw |
| 8,272,824 | B1 | 9/2012 | Putney |
| 8,317,502 | B1 | 11/2012 | Grey |
| 8,365,485 | B2 * | 2/2013 | Reyneveld ..... E04H 12/2269 52/295 |
| 8,464,996 | B2 | 6/2013 | Spindler |
| 8,820,007 | B2 * | 9/2014 | Knudsen ..... E04H 12/2215 52/165 |
| 9,033,619 | B2 | 5/2015 | Riggle, Jr. |
| 9,212,462 | B2 | 12/2015 | Borel |
| 9,297,179 | B2 | 3/2016 | Smith |
| 9,347,231 | B2 | 5/2016 | Cormier |
| 9,611,670 | B1 * | 4/2017 | Pacheco ..... A01K 15/04 |
| 9,988,823 | B1 | 6/2018 | Fisher |
| 10,427,916 | B1 | 10/2019 | Fisher |
| 10,633,887 | B1 * | 4/2020 | Fisher ..... B66C 23/18 |
| 10,662,046 | B1 | 5/2020 | Engebretson |
| 2003/0057747 | A1 | 3/2003 | Johnston |
| 2004/0218997 | A1 | 11/2004 | Neubauer |
| 2005/0218291 | A1 | 10/2005 | Musk |
| 2005/0220597 | A1 | 10/2005 | Burkett |
| 2006/0062655 | A1 | 3/2006 | Harrelson |
| 2006/0242921 | A1 | 11/2006 | Massie |
| 2008/0050213 | A1 | 2/2008 | Kundel |
| 2009/0057518 | A1 | 3/2009 | Russell |
| 2009/0107065 | A1 | 4/2009 | LeBlang |
| 2009/0267320 | A1 | 10/2009 | Phillips |
| 2011/0011018 | A1 | 1/2011 | Johnson |
| 2011/0033232 | A1 | 2/2011 | Adler |
| 2011/0057090 | A1 | 3/2011 | Spude |
| 2011/0305529 | A1 | 12/2011 | Riggle, Jr. |
| 2012/0131870 | A1 | 5/2012 | deMaere |
| 2013/0020732 | A1 | 1/2013 | Jentsch |
| 2013/0248680 | A1 | 9/2013 | Fergeson |
| 2013/0269284 | A1 | 10/2013 | Hovenier |
| 2014/0263942 | A1 | 9/2014 | Ciuperca |
| 2015/0052839 | A1 | 2/2015 | Rice |
| 2015/0081178 | A1 | 3/2015 | Billaud |
| 2016/0161047 | A1 | 6/2016 | Kaytee |
| 2016/0201408 | A1 | 7/2016 | Little |
| 2017/0218614 | A1 | 8/2017 | Ciuperca |
| 2018/0071949 | A1 | 3/2018 | Giles |
| 2018/0112389 | A1 | 4/2018 | Lake |
| 2018/0347213 | A1 | 12/2018 | Clevenger |
| 2018/0347227 | A1 * | 12/2018 | Neusch ..... E04H 17/1439 |
| 2019/0301118 | A1 * | 10/2019 | Neusch ..... E01F 15/0461 |

FOREIGN PATENT DOCUMENTS

| | | | |
|---|---|---|---|
| DE | 29915801 | U1 | 10/2000 |
| DE | 102012206353 | A1 | 10/2013 |
| EP | 2308790 | A1 | 4/2011 |
| EP | 3179010 | A1 | 6/2017 |
| FR | 2951149 | B1 | 4/2011 |
| FR | 2973360 | A1 | 10/2012 |
| FR | 3032953 | B1 | 8/2016 |
| FR | 3045692 | A1 | 6/2017 |
| JP | 11309687 | A | 11/1999 |
| SU | 903530 | A1 | 2/1982 |

OTHER PUBLICATIONS http://www.aluminumconcreteforms.com/concrete_forming_systems.htm; Wall-Ties & Forms Concrete Forming Systems and Formwork Website Page.

http://www.daytonsuperior.com/search#?sections=products&productlines=forming; Dayton Product Search Website Page.

Dayton Forming Accessories Handbook.

Dayton Rapid Clamp System Manual.

Dayton Steel Ply System Manual.

(56) References Cited

OTHER PUBLICATIONS

Harsco LOGIK Forming System Manual.
PCT International Search Report and Written Opinion for PCT Application PCT/US2018/20499.
MeadowBurke Sure-Lock Strand Chucks Publication; Oct. 2008.
PCT International Search Report and Written Opinion for PCT application PCT/US2018/062473.
https://www.nogalesinternational.com/news/bollard-border-fence-draws-good-reviews-on-first-anniversary/article_3c0e21c6-e884-11e1-aedc-001a4bcf887a.html; Bollard Border Fence Draw Good Review on First Anniversary; Brenna Goth; Aug. 17, 2012.
https://www.nationalreview.com/the-morning-jolt/trumps-great-wall-isnt-whats-being-built/; National Review Website Article Trumps Great Wall Isn't What's Being Built; Dec. 12, 2018.
https://www.businessinsider.com/trump-border-wall-construction-photos-new-mexico-2018-4;Trump Administration Releases New Photos of Border Wall Article; Apr. 11, 2018.
http://theminiaturespage.com/boards/msg.mv?id=452833; The Miniatures Page Message Board Bollard Wall Thread; May 5, 2017.
PCT International Search Report and Written Opinion for PCT Application PCT/US2019/051220.

* cited by examiner

BOLLARD WALL SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a bollard wall system for efficiently assembling a bollard wall.

Related Art

Any discussion of the related art throughout the specification should in no way be considered as an admission that such related art is widely known or forms part of common general knowledge in the field.

Bollard walls are used to provide a physical barrier that prevents passage of humans, animals and vehicles while still allowing visibility through the wall. One example of bollard walls in use today is for border protection between adjacent countries.

SUMMARY

An example embodiment is directed to a bollard wall system. An example embodiment of the bollard wall system generally includes a support structure having a plurality of sleeves adapted to be positioned within a trench filled with concrete, and a plurality of bollards positioned within the plurality of sleeves in a vertical manner. Each of the plurality of bollards are lifted and lowered into a corresponding one of the plurality of sleeves by a crane vehicle to form a bollard wall.

There has thus been outlined, rather broadly, some of the embodiments of the bollard wall system in order that the detailed description thereof may be better understood, and in order that the present contribution to the art may be better appreciated. There are additional embodiments of the bollard wall system that will be described hereinafter and that will form the subject matter of the claims appended hereto. In this respect, before explaining at least one embodiment of the bollard wall system in detail, it is to be understood that the bollard wall system is not limited in its application to the details of construction or to the arrangements of the components set forth in the following description or illustrated in the drawings. The bollard wall system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
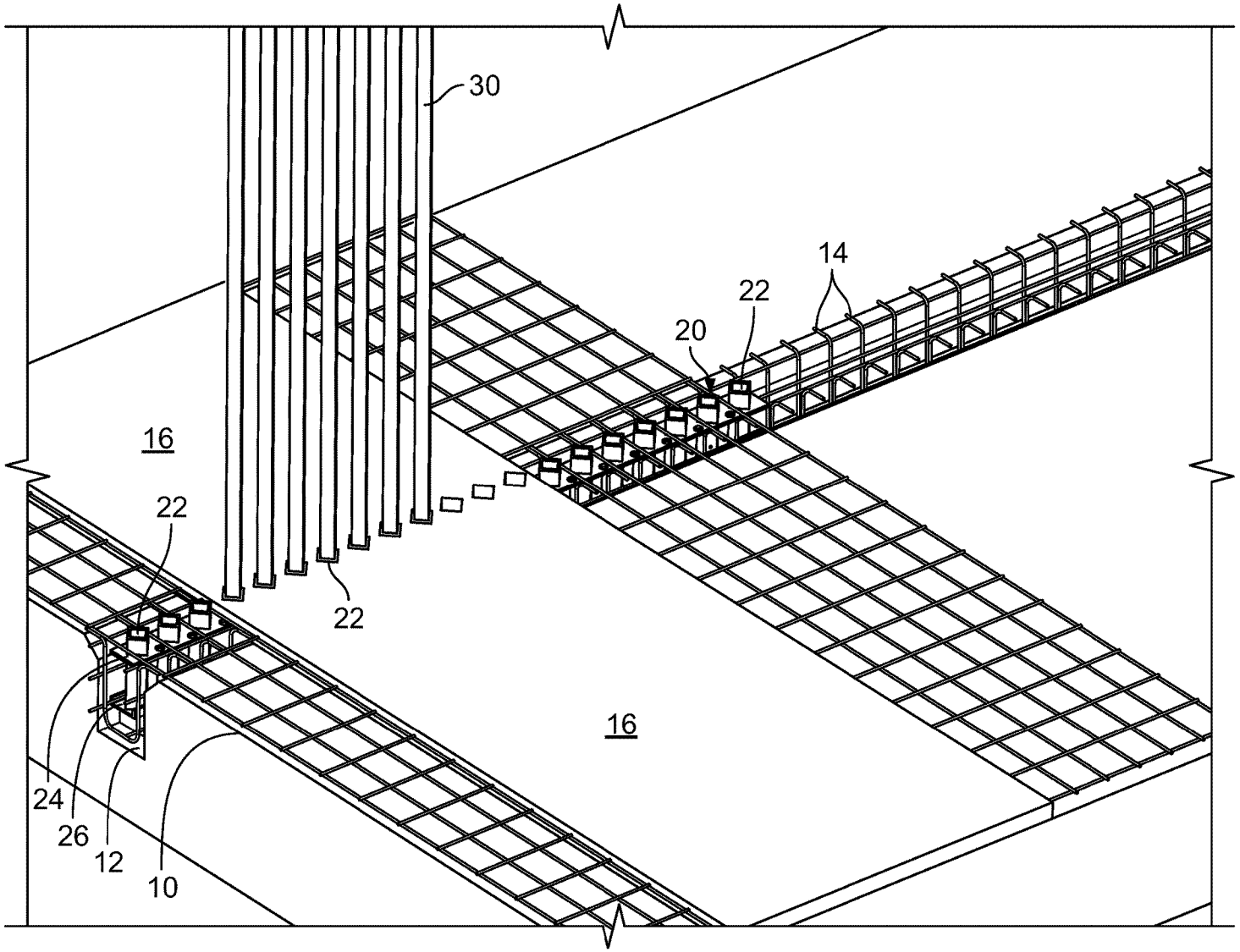
FIG. 1 is a perspective partial cutaway view of a bollard wall system in accordance with an example embodiment.

An example embodiment of a bollard wall generally comprises a support structure 20 having a plurality of sleeves 22 adapted to be positioned within a trench 12 filled with concrete 18, and a plurality of bollards 30 positioned within the plurality of sleeves 22 in a vertical manner. Each of the plurality of bollards 30 are lifted and lowered into a corresponding one of the plurality of sleeves 22 by a crane vehicle 11 to form a bollard 30 wall.

B. Trench

Figure 9A:
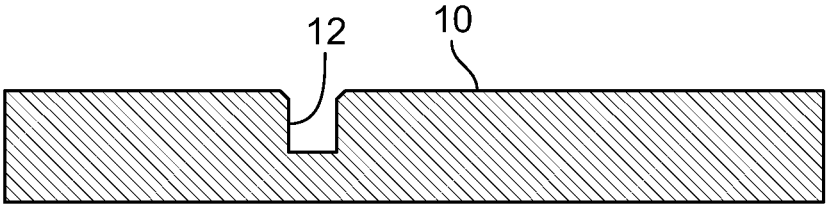
FIG. 9A is a cutaway view of a trench created within a ground surface in accordance with an example embodiment.

FIGS. 1, 3, 7, 9A and 9B illustrate an exemplary trench 12 within a ground surface 10 suitable for use with the various embodiments disclosed herein. FIG. 9A illustrates a generally rectangular shaped cross section for the trench 12 with vertical sidewalls and a horizontal floor in one embodiment. The trench 12 may have various other shapes such as angled sidewalls and a non-horizontal floor. The trench 12 may be dug into the ground surface 10 using various types of trench 12*ing* machines.

The trench 12 may have various depths and widths suitable for providing support to the wall formed by the plurality of bollards 30. In one example embodiment, the trench 12 is between three feet to four feet in depth, but the trench 12 may alternatively have greater depths or shallower depths depending on the wall to be installed, ground conditions and environmental conditions. The trench 12 may have various lengths and may extend for miles to allow for assembly of the wall formed by a plurality of bollards 30. The trench 12 may be dug in front of the installation of the support structure 20 and bollards 30.

Figure 2:
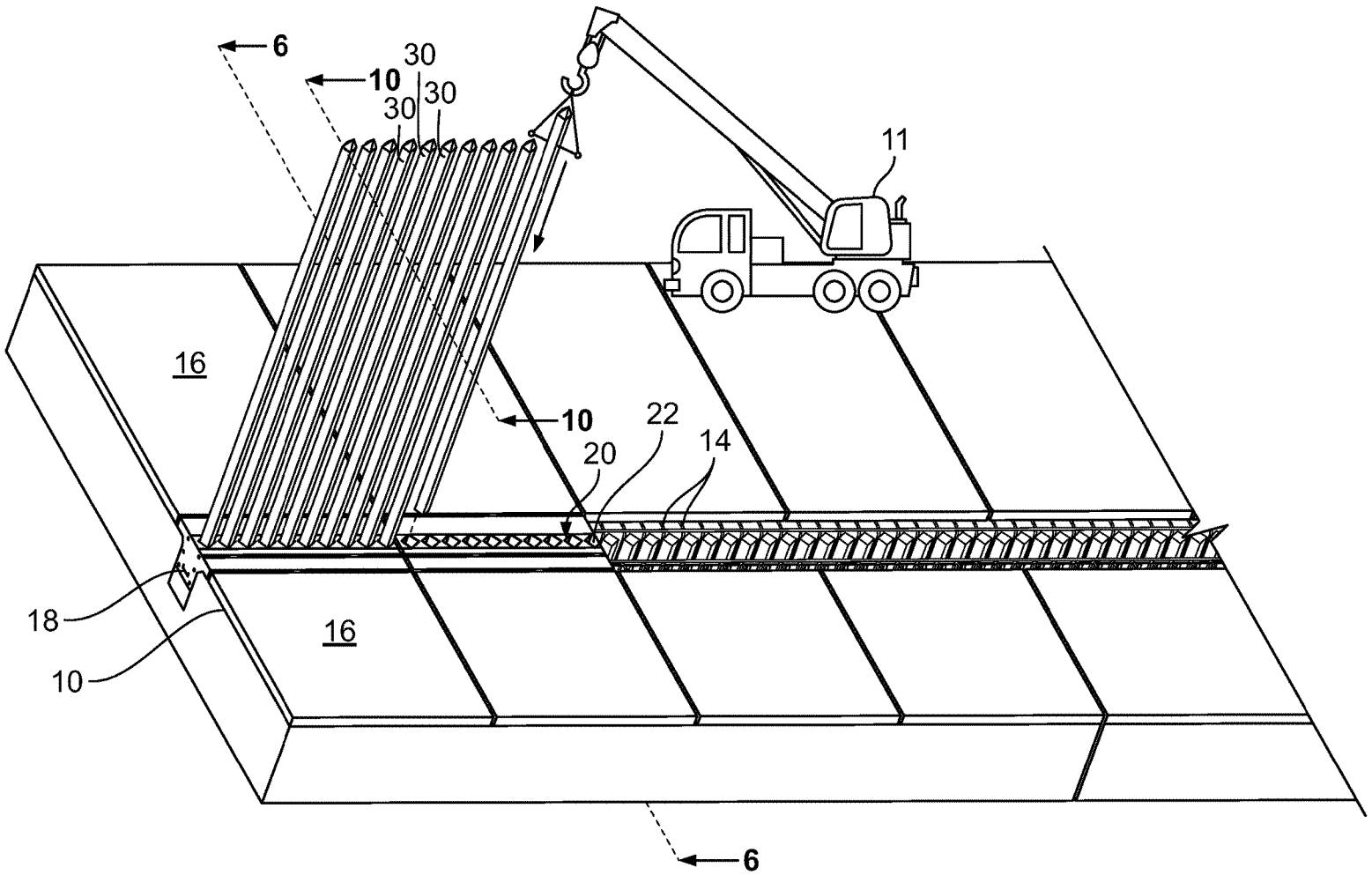
FIG. 2 is a perspective view of a bollard wall system in accordance with an example embodiment.
Figure 7:
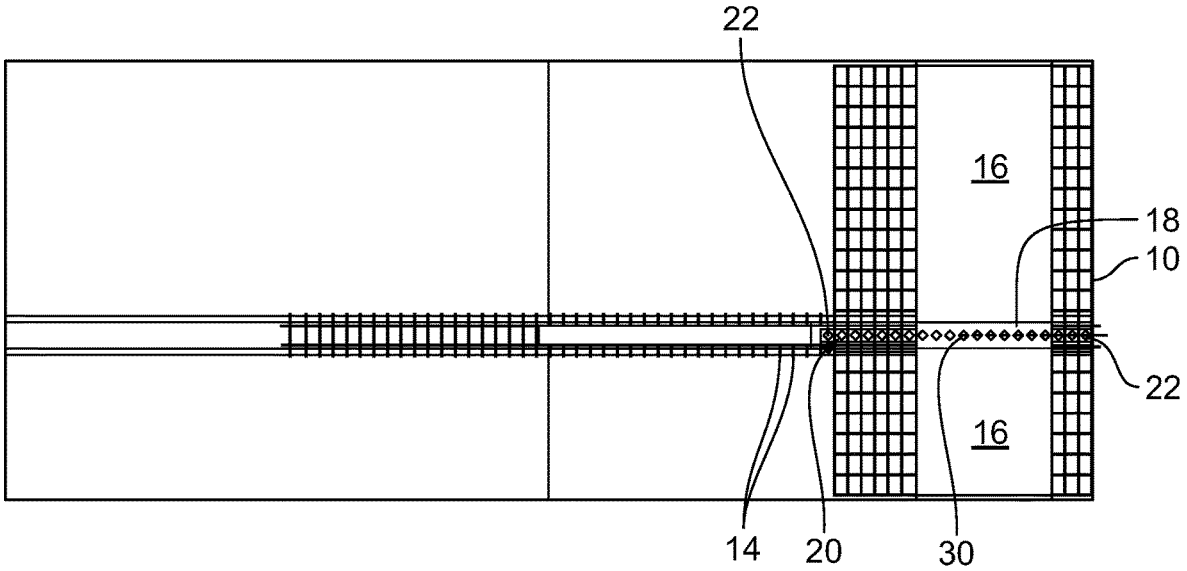
FIG. 7 is a top view of a bollard wall system in accordance with an example embodiment.

In one embodiment, the trench 12 may be dug into the ground surface 10 prior to forming one or more roads 16 along the wall formed by the plurality of bollards 30 as shown in FIGS. 1, 7 and 9A of the drawings. In another embodiment, the trench 12 may be dug into the ground surface 10 after forming one or more roads 16 along the wall as shown in FIG. 2 of the drawings.

Figure 9B:
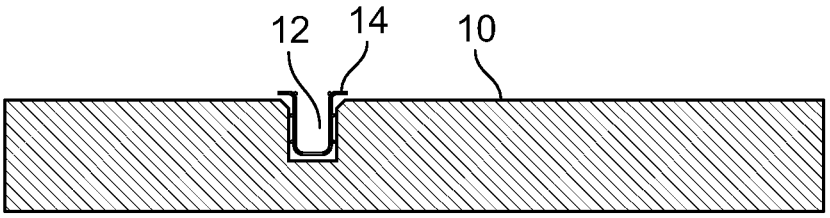
FIG. 9B is a cutaway view of rebar positioned within the trench of FIG. 9A.

After the trench 12 is formed into the ground surface 10, a plurality of rebar 14 may be positioned within the trench 12 prior to or after inserting the support structure 20 into the trench 12 to provide additional support to the concrete 18 within the trench 12. In one embodiment, a plurality of U-shaped rebar 14 are positioned within the trench 12 prior to inserting the support structure 20 as shown in FIGS. 1, 3, 7 and 9B of the drawings. The U-shaped rebar 14 may have flanged upper ends that extend parallel with the ground surface 10 as best illustrated in FIG. 9B of the drawings.

C. Support Structure

The support structure 20 is positioned at least partially within the trench 12 before or after insertion of the rebar 14 within the trench 12 (if rebar 14 is used). The support structure 20 is configured to support the plurality of bollards 30 in a vertical and parallel manner adjacent to one another as illustrated in FIGS. 1 through 3 of the drawings.

The support structure 20 includes a plurality of sleeves 22 connected together in series as shown in FIGS. 1 through 4 of the drawings. The support structure 20 may have one row of sleeves 22 as shown in FIGS. 1 through 4 or a plurality of rows that are parallel to one another (not shown). The support structure 20 is constructed of a rigid material capable of receiving and supporting the bollards 30 such as but not limited to steel.

Figure 3:
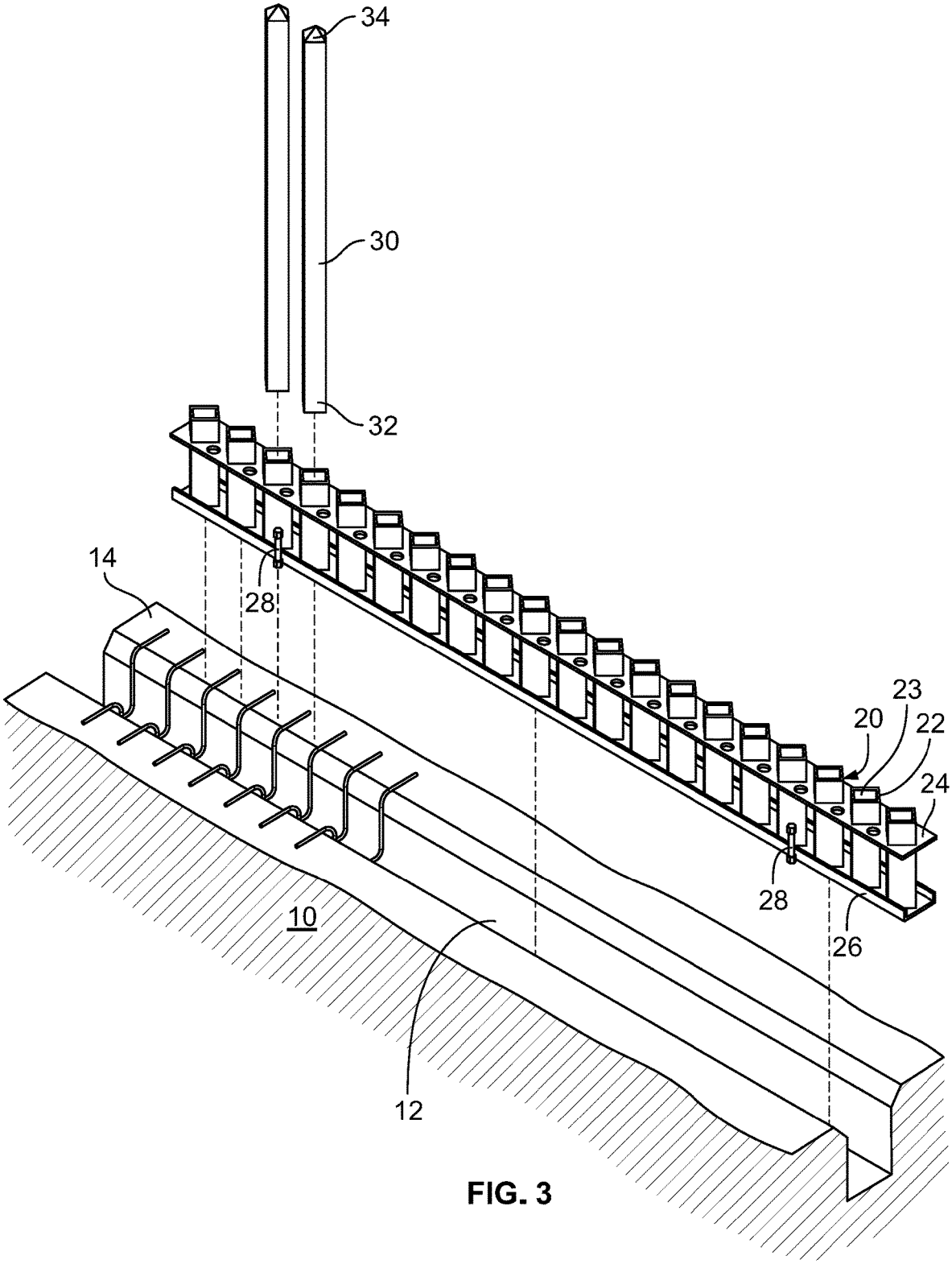
FIG. 3 is an exploded perspective view of a bollard wall system in accordance with an example embodiment.
Figure 4:
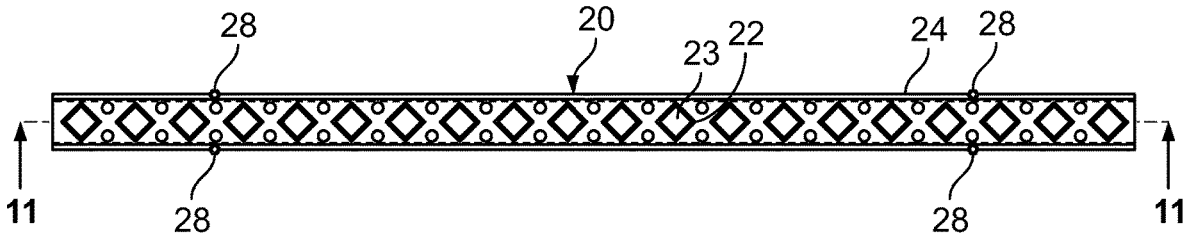
FIG. 4 is a top view of a bollard support structure in accordance with an example embodiment.
Figure 10:
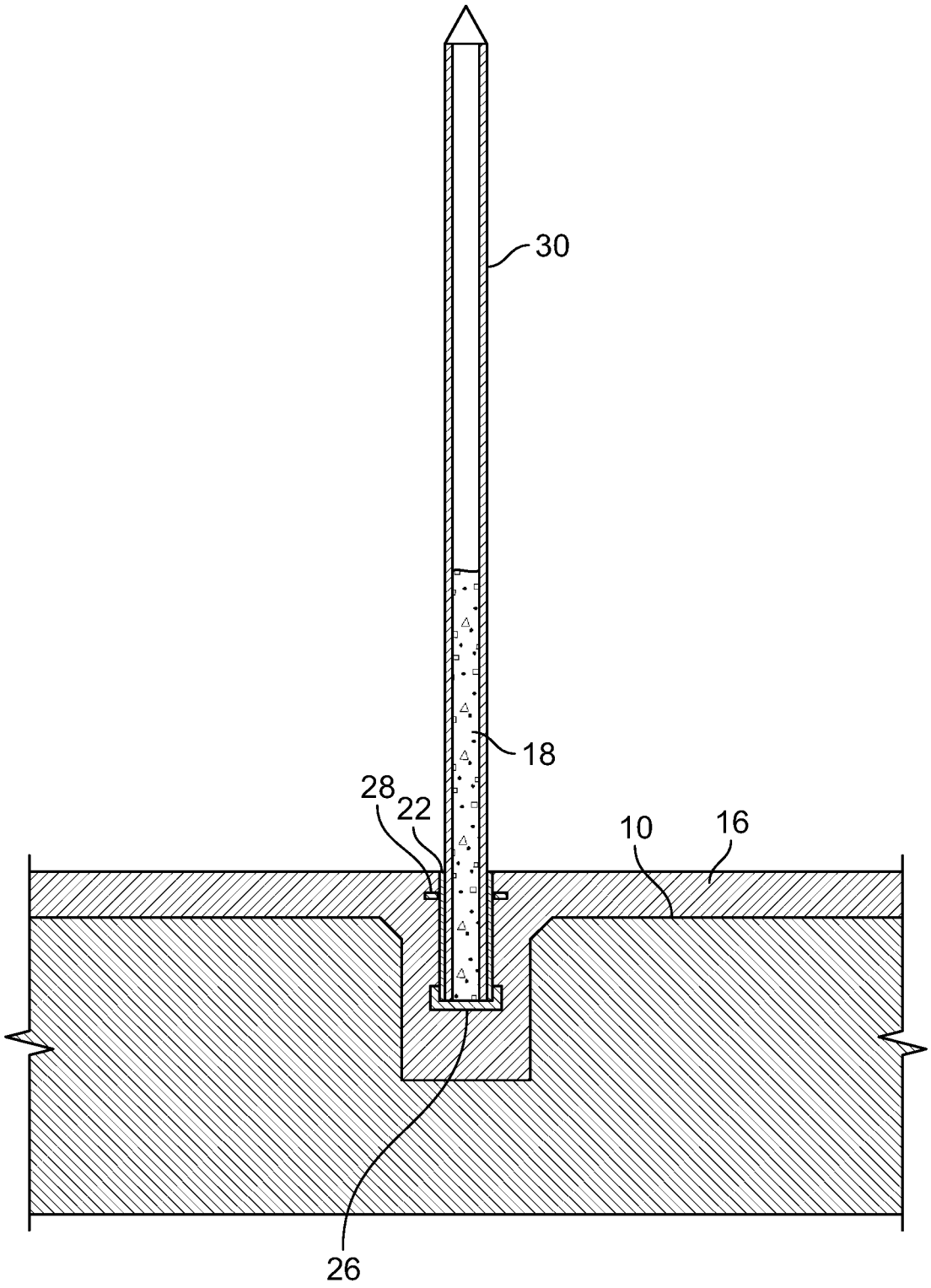
FIG. 10 is a cross sectional view taken along line 10-10 of FIG. 2.
Figure 11:
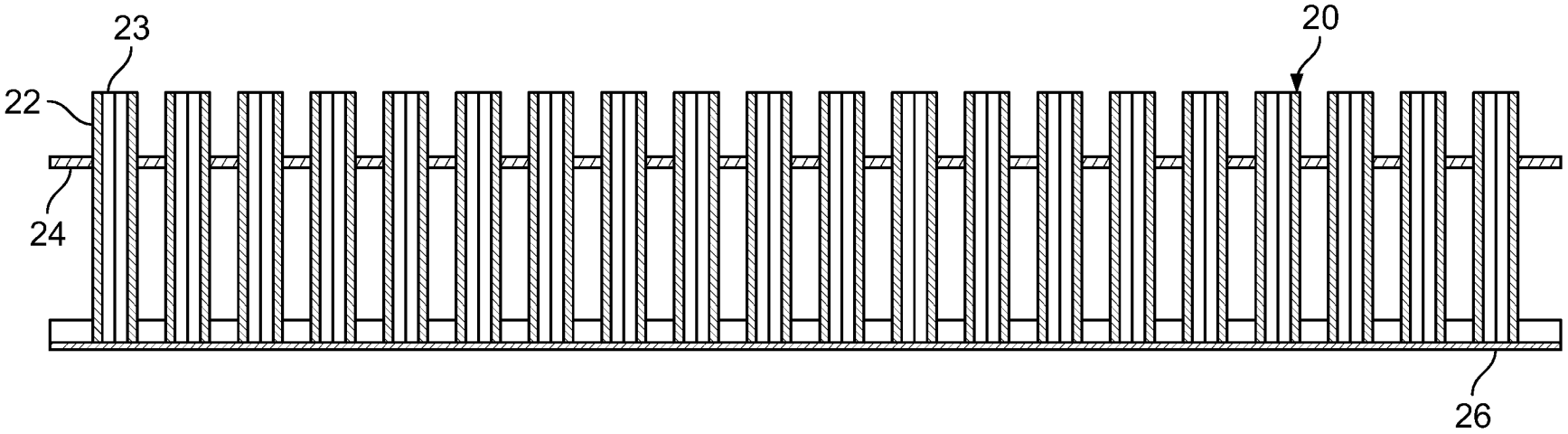
FIG. 11 is a cross sectional view of the bollard support structure taken along line 11-11 of FIG. 4.

Each of the plurality of sleeves 22 includes a lumen and an upper opening 23 connected to the lumen for receiving one of the plurality of bollards 30 as shown in FIGS. 3 and 4 of the drawings. The upper opening 23 and the lumen of each of the sleeves 22 are sized and shaped to snugly receive the outer surface of each bollard 30 as illustrated in FIG. 10 of the drawings. The bottom end of the sleeves 22 may be open, partially closed or fully closed.

Figure 5:
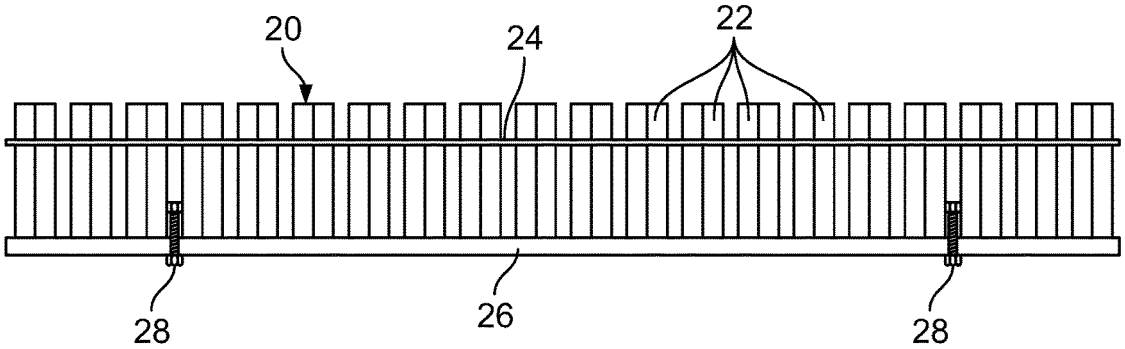
FIG. 5 is a side view of a bollard support structure in accordance with an example embodiment.
Figure 6:
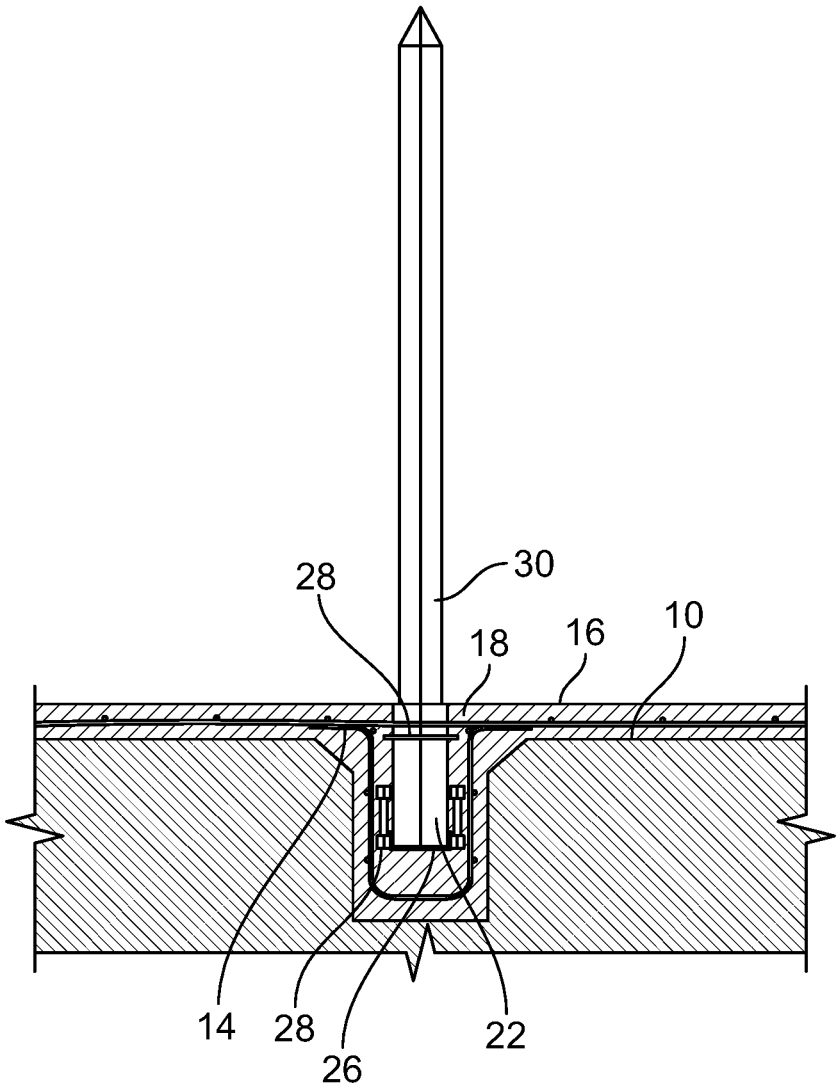
FIG. 6 is a cross sectional view taken along line 6-6 of FIG. 2.

The sleeves 22 are preferably consistent in shape and size as illustrated in FIGS. 3 through 5 of the drawings, however the sleeves 22 may be different from one another. In one embodiment shown in FIG. 4 of the drawings, the sleeves 22 each have a rectangular cross sectional area to receive a bollard 30 having a similar cross sectional area but various other shapes may be used. In one embodiment, the length of the sleeves 22 are approximately two feet to provide sufficient support for the bollards 30 but the length of the sleeves 22 may be greater than or less than two feet. The sleeves 22 are further preferably parallel to one another as illustrated in FIGS. 5 and 8 of the drawings, but the sleeves 22 may alternatively not be parallel to one another.

Figure 8:
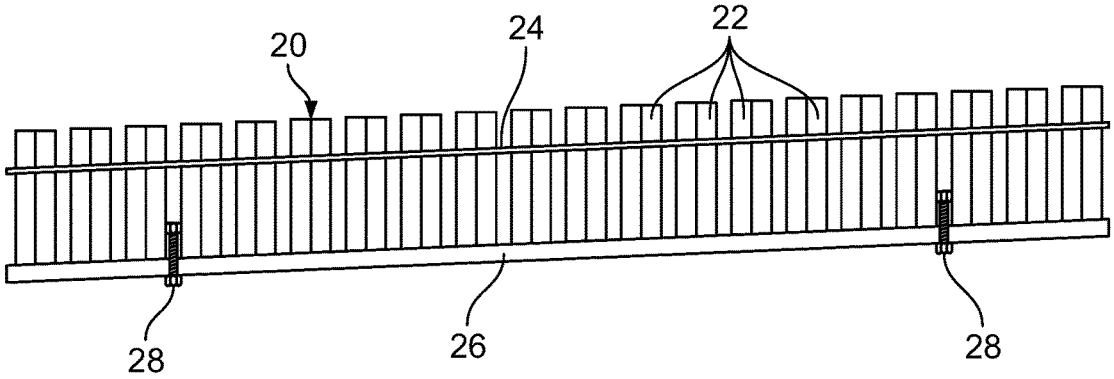
FIG. 8 is a side view of a bollard support structure for a ground surface having a grade in accordance with an example embodiment.

Each of the plurality of sleeves 22 are preferably vertically orientated and parallel to one another as shown in FIGS. 5 and 8 of the drawings. The plurality of sleeves 22 are preferably connected along a longitudinal axis as shown in FIG. 4 of the drawings, but the plurality of sleeves 22 may be connected in a non-longitudinal manner. The plurality of sleeves 22 are further preferably equidistantly spaced along a longitudinal axis as further shown in FIG. 4 but may be spaced apart at different distances.

In one embodiment shown in FIG. 5, the plurality of sleeves 22 may be aligned with the upper opening 23 of each of the plurality of sleeves 22 positioned along a horizontal plane which is suitable for flat grade ground surface 10 that is substantially horizontal. In another embodiment shown in FIG. 8, the plurality of sleeves 22 may be aligned with the upper the upper opening 23 of each of the plurality of sleeves 22 positioned along an angled plane having an angle with respect to a horizontal plane for use on angled ground surface 10. In another embodiment, the upper opening 23 of each of the plurality of sleeves 22 may not be aligned along a common plane and may have differing positions.

In one embodiment, the support structure 20 includes a lower support member 26 attached to the lower portion of each of the plurality of sleeves 22 to provide support for the sleeves 22. In another embodiment, the lower support member 26 is attached to and encloses a lower end of each of the plurality of sleeves 22. The lower support member 26 is attached to the plurality of sleeves 22. In one embodiment, the lower support member 26 is comprised of a length of channel iron. In another embodiment, a bottom end (or bottom portion) of each of the plurality of sleeves 22 is welded to the length of channel iron and positioned within a channel of the length of channel iron. The lower support member 26 may be comprised of various other structures than channel iron such as a flat piece of iron or angle iron. The lower support member 26 is preferably elongated and straight as illustrated in the various embodiments, but the lower support member 26 may have various other shapes and structures other than shown in the figures.

In another embodiment, the support structure 20 includes an upper support member 24 attached to an upper portion 34 (or top end) of each of the plurality of sleeves 22 to provide support for the sleeves 22. In one embodiment as shown in FIGS. 1, 5 and 8 of the drawings, the upper support member 24 is attached to the sleeves 22 in combination with the lower support member 26. In an alternative embodiment, the support structure 20 may only include the upper support member 24 or a middle support member attached to a central portion of the sleeves 22 (not shown). In one embodiment, the upper support member 24 is a flat piece of elongated straight metal that is flat as illustrated in FIGS. 3 through 6 of the drawings. Alternatively, the upper support member 24 may be various other structures such as but not limited to one or more pieces of angle iron attached to the sleeves 22.

D. Adjustment Members

In one alternative embodiment shown in FIGS. 3 through 6 and 8, a plurality of adjustment members 28 attached to the support structure 20 to provide for adjustment of the position and attitude of the support structure 20 within the trench 12 prior to filling the trench 12 with concrete 18 or other material. Because the ground surface 10 is rarely perfectly flat and horizontal, the adjustment members 28 allow for adjustment of the position of the support structure 20 to align the top ends of the sleeves 22 with a desired elevation and angle.

In one embodiment shown in FIG. 4 of the drawings, a first pair of adjustment members 28 are connected on opposing sides near a first end of the support structure 20 and a second pair of adjustment members 28 are connected on opposing sides near a second end of the support structure 20. Various other configurations and locations may be used for the plurality of adjustment members 28.

Figure 9C:
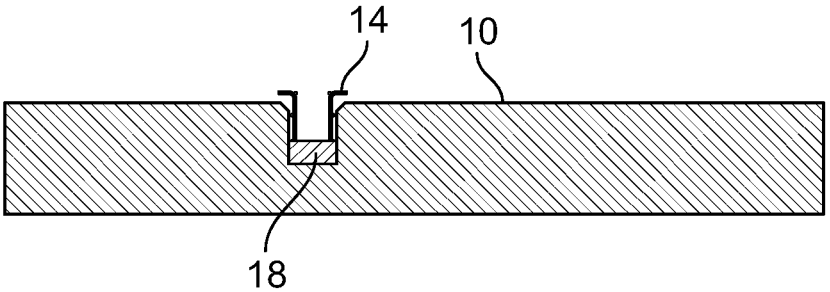
FIG. 9C is a cutaway view of a base level of concrete within the trench of FIG. 9B.
Figure 9D:
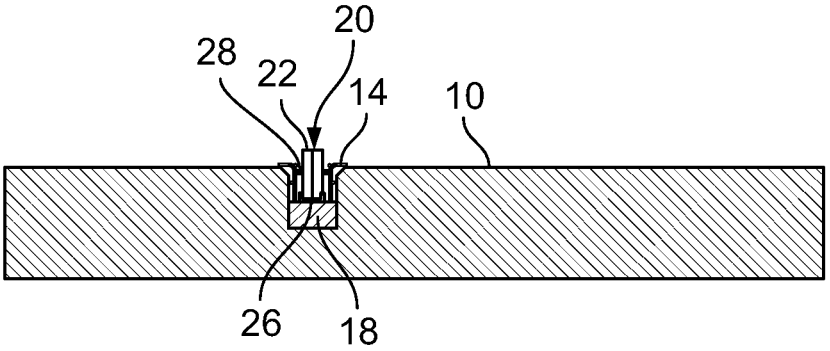
FIG. 9D is a cutaway view of the bollard support structure positioned in the trench of FIG. 9C.

The plurality of adjustment members 28 extend downwardly below the support structure 20 in an adjustable manner to engage a base level of concrete 18 within the trench 12 as shown in FIG. 9D of the drawings or the floor of the trench 12. In one embodiment, each of the plurality of adjustment members 28 are comprised of a threaded member (e.g. exteriorly threaded bolt) threadably connected to the support structure 20 either threadably through the lower support member 26 or by an interiorly threaded member (e.g. a threaded nut) attached to the support structure 20 to threadably receive the threaded member. In another embodiment not shown, the adjustment members 28 may be comprised of a telescoping device such as an actuator (e.g. electric actuator, hydraulic actuator). In another embodiment, the adjustment members 28 may be secured to the support structure 20 at a desired static position after the support structure 20 is moved to a desired position with lifting equipment (e.g. a crane vehicle 11).

The users adjust the position of the support structure 20 within the trench 12 by adjusting the position of one or more of the adjustment members 28 (e.g. by rotating with a wrench) with respect to the support structure 20 thereby lifting or lowering one or more portions of the support structure 20 within the trench 12. Once the support structure 20 is at a desired position within the trench 12, no further adjustment of the adjustment members 28 is needed.

After the support structure 20 is properly positioned within the trench 12, a volume of concrete 18 is poured within the trench 12 to fill the trench 12 and surround the support structure 20 with the exception of the upper openings 23 within the sleeves 22 which are exposed through an upper surface of the volume of concrete 18 as shown in FIGS. 1 and 2 of the drawings. Various types of concrete 18 or other non-concrete 18 material may be used to secure the support structure 20 within the trench 12. After the concrete 18 has hardened, the bollards 30 may be installed within the sleeves 22 as shown in FIGS. 1 through 3 of the drawings.

E. Bollards

FIGS. 1 through 3, 6, 9F and 9G illustrate a plurality of exemplary bollards 30 that are suitable for use with the various embodiments disclosed herein. Various shapes (e.g. rectangular, tapering, etc.), sizes and lengths may be used for the plurality of bollards 30. For example, each of the bollards 30 may have a length of 24 feet with approximately two feet of the lower part of the bollards 30 positioned within the sleeves 22. Various other lengths may be used for the bollards 30 depending upon the application of the wall. The bollards 30 are preferably straight and parallel to one another in an equidistantly spaced manner as shown in FIGS. 1 and 2 of the drawings. After the bollards 30 are installed within the sleeves 22 of the support structure 20, corresponding vertical spaces exist between the bollards 30 as shown in FIGS. 1 and 2 of the drawings.

Each of the plurality of bollards 30 has a lower portion 32 that is positionable within a corresponding one of the plurality of sleeves 22 as shown in FIGS. 1 through 3 of the drawings. The lower portion 32 of the bollard 30 may be approximately two feet in length but may be greater or less than two feet depending upon various factors for the wall.

Each of the bollards 30 is preferably constructed of tubular metal but various other types of bollards 30 and structures may be used. In one embodiment shown in FIG. 10, the bollard 30 is at least partially filled with concrete 18 from the lower end to a defined point for added strength of the bollards 30 and to increase the weight (e.g. 1,000 pounds or more in some embodiments to prevent easy removal of the bollards 30 from the sleeves 22). In another embodiment, the bollards 30 are at least partially filled with concrete 18 and rebar 14. In another embodiment, the bollards 30 are not filled with concrete 18. The bollards 30 are preferably filled with concrete 18 off-site prior to installation of the bollards 30 within the support structure 20, but the bollards 30 may be filled with concrete 18 at the installation site of the wall.

F. Roads

In one embodiment, one or more roads 16 are formed on opposing sides of the support structure 20 and the wall formed by the plurality of bollards 30 to allow for vehicles 11 to travel along the wall for various reasons. FIGS. 1 and 2 illustrate in one embodiment the usage of a first road 16 and a second road 16 on opposing sides of the plurality of bollards 30, wherein the first road 16 is parallel to the second road 16. It can be appreciated that no roads 16 are formed near the wall. The roads 16 are preferably constructed of concrete 18 but various other materials (e.g. asphalt, gravel) may be used. The roads 16 may be formed concurrently with the filling of the trench 12 with concrete 18 with a concrete 18 paving machine (e.g. GOMACO® brand concrete 18 paving machine) as shown in FIG. 1 or alternatively the roads 16 may be formed with a space (e.g. approximately four feet) between them prior to digging the trench 12 so that a trench 12 may then be dug between the roads 16 as shown in FIG. 2 of the drawings.

G. Operation of Preferred Embodiment

In one preferred embodiment for assembling the wall of bollards 30, the ground surface 10 is graded to a desired level along the area to assemble the wall. The trench 12 may be dug by a trench 12*ing* machine (e.g. excavator, trench 12*er*, etc.) prior to paving the roads 16 on opposite sides of the wall as shown in FIGS. 1 and 9A. Alternatively, the trench 12 may be dug by the trench 12*ing* machine after paving the roads 16 on opposite sides of the wall where a space is left exposed in the ground surface 10 between the two roads 16 (e.g. four feet) as shown in FIG. 2 of the drawings. The roads 16 may be constructed using concrete 18, asphalt or other material suitable for constructing a road 16.

After the trench 12 is created, rebar 14 may be positioned within the trench 12 for added support for the concrete 18 or other material used to fill the trench 12 as shown in FIGS. 1 through 3 and 9B of the drawings. In one embodiment, a base level of concrete 18 (e.g. 10 inches in depth) may be first poured into the trench 12 and allowed to cure to provide support for the support structure 20 as shown in FIG. 9C of the drawings. Alternatively, a base level of concrete 18 is not poured prior to inserting the support structure 20 into the trench 12.

The support structure 20 is at least partially positioned within the trench 12 with the sleeves 22 oriented upwardly in a vertical manner by a crane vehicle 11 or other device capable of lifting/lowering the support structure 20 into the trench 12 as shown in FIGS. 1 through 3 and 9D of the drawings. As shown in FIG. 9D, the upper ends of the sleeves 22 preferably extend upwardly above the ground surface 10 to compensate for the level of concrete 18 to be poured into the trench 12 and onto the surrounding ground surface 10. However, the upper ends of the sleeves 22 may be positioned parallel to or below the ground surface 10 in some embodiments.

After the support structure 20 is positioned within the trench 12, the adjustment members 28 are adjusted so that the sleeves 22 of the support structure 20 are properly aligned in a vertical manner so that the plurality of bollards 30 are vertically aligned after being installed within the sleeves 22. For example, if the first side of the support structure 20 is lower than the opposite second side of the support structure 20, the adjustment members 28 on first side could be extended downwardly to raise the first side of the support structure 20 and/or the adjustment members 28 on the second side could be raised upwardly to lower the second side of the support structure 20. As another example, if the first end of the support structure 20 is lower than the opposite second end of the support structure 20, the adjustment members 28 on first end could be extended downwardly to raise the first end of the support structure 20 and/or the adjustment members 28 on the second end could be raised upwardly to lower the second end of the support structure 20.

Figure 9E:
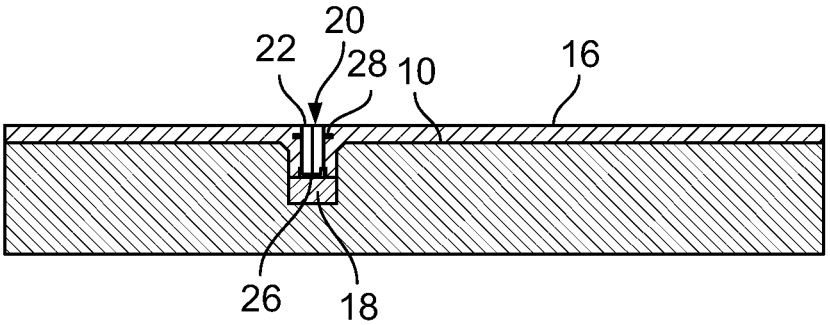
FIG. 9E is a cutaway view of the trench of FIG. 9D filled with concrete in accordance with an example embodiment.

After the support structure 20 is properly aligned so that the sleeves 22 are vertically aligned, concrete 18 is poured into the trench 12 to at least partially surround the support structure 20 as shown in FIGS. 1, 2 and 9E of the drawings. If the roads 16 are installed prior to the trench 12 (or installed around the trench 12), the concrete 18 will fill the trench 12 to approximately the level of the roads 16. If the roads 16 are not installed prior to digging the trench 12, the roads 16 may be paved with concrete 18 concurrently with filling the trench 12 by a concrete 18 paving machine. The upper openings 23 within the sleeves 22 are not filled with concrete 18 by either having the upper openings 23 of the sleeves 22 positioned above the upper level of the concrete 18 or by removable inserts being positioned within the upper openings 23 to prevent concrete 18 from entering the sleeves 22. The concrete 18 is allowed to cure thereby securing the support structure 20 within the trench 12 in a manner capable of supporting the plurality of bollards 30.

Figure 9F:
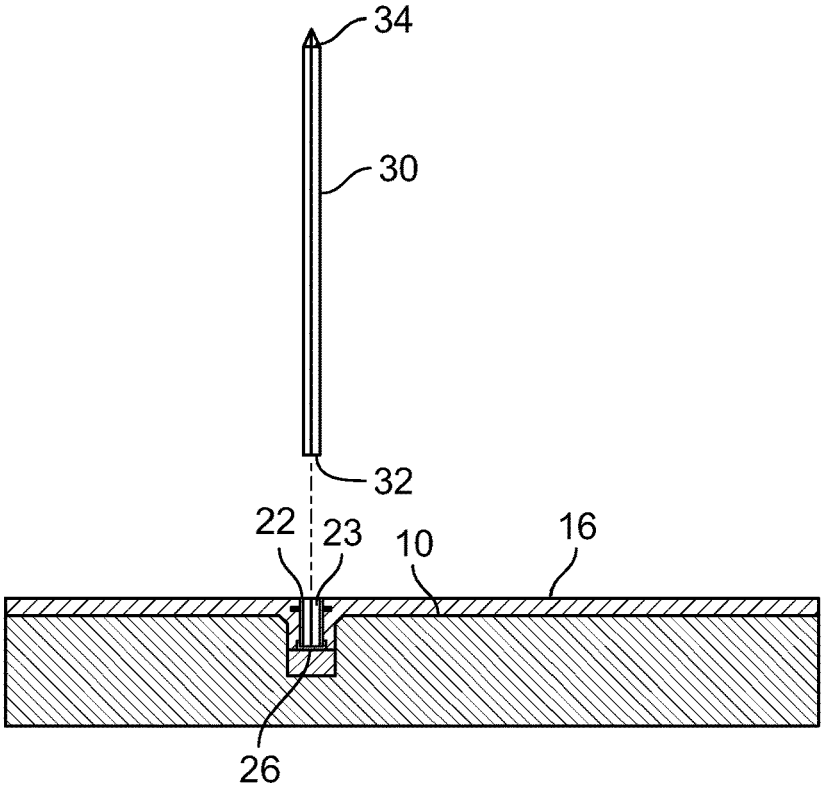
FIG. 9F is an exploded cutaway view of a bollard positioned above a sleeve of the bollard support structure in accordance with an example embodiment.
Figure 9G:
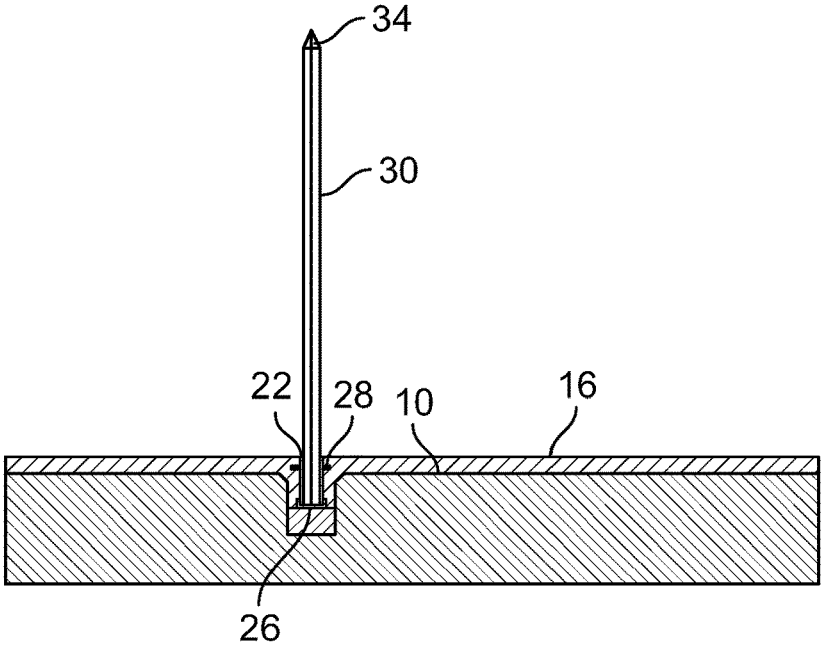
FIG. 9G is a cutaway view of a bollard positioned within a sleeve of the bollard support structure in accordance with an example embodiment.

After the concrete 18 within the trench 12 has cured sufficiently, the crane vehicle 11 (e.g. mobile crane, carry deck crane, crawler crane, rough terrain crane, truck-mounted crane, boom lift, etc.) or other vehicle 11 capable of lifting a heavy bollard 30 (e.g. tractor with loader attachment, telehandler, excavator, etc.) is connected to the first bollard 30 and then lifts the first bollard 30 above a first sleeve 22 in vertical alignment with the upper opening 23 and lumen of the first sleeve 22 as shown in FIGS. 2, 3 and 9F of the drawings. The vehicle 11 may be connected to the bollards 30 in various manners (e.g. fasteners, cable loops, etc.) capable of lifting and lowering the bollards 30 in a vertical manner above the sleeves 22. After the first bollard 30 is aligned with the first sleeve 22, the vehicle 11 then lowers the first bollard 30 so that at least a portion of the lower portion 32 of the bollard 30 is lowered into and positioned within the lumen of the first sleeve 22. The bottom end of the first bollard 30 is stopped from further vertical movement by the lower support member 26 or other structure within the first sleeve 22 as shown in FIGS. 9G and 10 of the drawings.

After the first bollard 30 is positioned within the first sleeve 22, the process is then repeated for the second bollard 30 to be positioned in the second sleeve 22 and so forth to construct the wall of bollards 30 are shown in FIGS. 1 and 2 of the drawings. It can be appreciated that one or more vehicles 11 may be used simultaneously to position the bollards 30 within the sleeves 22.

The bollards 30 may be permanently attached to the sleeves 22 by welding or other permanent fasting method. The bollards 30 may be removably positioned within the sleeves 22 to allow for removal of one or more bollards 30 for various reasons (e.g. repair, temporary access, etc.) using a crane vehicle 11. If the bollards 30 are removably positioned within the sleeves 22, the weight of the bollards 30 (typically 1,000 pounds or more) would make it difficult for anyone to intentionally remove the bollards 30 without using a crane vehicle 11.

The above process may be continued in series along a length of where the wall of bollards 30 is to be constructed. The above process may be performed by one or many different crews in different locations along where the wall of bollards 30 is to be constructed to help expedite construction.

Unless otherwise defined, all technical and scientific terms used herein have the same meaning as commonly understood by one of ordinary skill in the art to which this invention belongs. Although methods and materials similar to or equivalent to those described herein can be used in the practice or testing of the bollard wall system, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The bollard wall system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A bollard wall system, comprising:

a support structure positioned at least partially within a trench of a ground surface, wherein the support structure includes a plurality of sleeves connected together, wherein each of the plurality of sleeves includes a lumen and an upper opening connected to the lumen, and wherein each of the plurality of sleeves are vertically orientated;

a plurality of bollards, wherein each of the plurality of bollards have a lower portion positioned within a corresponding one of the plurality of sleeves; and a volume of concrete within the trench and surrounding the support structure, wherein the upper opening for each of the plurality of sleeves is exposed through an upper surface of the volume of concrete.

2. The bollard wall system of claim 1, wherein the plurality of sleeves are connected along a longitudinal axis.

3. The bollard wall system of claim 1, wherein each of the plurality of sleeves has a rectangular cross sectional area.

4. The bollard wall system of claim 1, wherein each of the plurality of sleeves are spaced apart equidistantly along a longitudinal axis.

5. The bollard wall system of claim 1, wherein the support structure includes a lower support member attached to a lower portion of each of the plurality of sleeves.

6. The bollard wall system of claim 5, wherein the lower support member encloses a lower end of each of the plurality of sleeves.

7. The bollard wall system of claim 5, wherein the lower support member is comprised of a length of channel iron.

8. The bollard wall system of claim 7, wherein a lower end of each of the plurality of sleeves is welded to the length of channel iron and positioned within a channel of the length of channel iron.

9. The bollard wall system of claim 5, wherein the support structure includes an upper support member attached to an upper portion of each of the plurality of sleeves.

10. The bollard wall system of claim 1, wherein the plurality of sleeves are parallel to one another.

11. The bollard wall system of claim 1, wherein the plurality of sleeves are aligned with the upper opening of each of the plurality of sleeves positioned along a horizontal plane.

12. The bollard wall system of claim 1, wherein the plurality of sleeves are aligned with the upper opening of each of the plurality of sleeves positioned along an angled plane having an angle with respect to a horizontal plane.

13. The bollard wall system of claim 1, including a plurality of U-shaped rebar within the trench surrounding the support structure.

14. The bollard wall system of claim 1, including a plurality of adjustment members attached to the support structure, wherein the plurality of adjustment members extend downwardly below the support structure in an adjustable manner to allow for adjustment of an attitude of the support structure within the trench.

15. The bollard wall system of claim 14, wherein each of the plurality of adjustment members are comprised of a threaded member threadably connected to the support structure.

16. The bollard wall system of claim 1, including a first road and a second road on opposing sides of the plurality of bollards.

17. A bollard wall system, comprising:

a support structure positioned at least partially within a trench of a ground surface, wherein the support structure includes a plurality of sleeves connected together, wherein each of the plurality of sleeves includes a lumen and an upper opening connected to the lumen, and wherein each of the plurality of sleeves are vertically orientated;

wherein the plurality of sleeves are connected along a longitudinal axis;

wherein each of the plurality of sleeves are spaced apart equidistantly along the longitudinal axis;

wherein each of the plurality of sleeves has a rectangular cross sectional area;

wherein the plurality of sleeves are parallel to one another;

a plurality of adjustment members attached to the support structure, wherein the plurality of adjustment members extend downwardly below the support structure in an adjustable manner to allow for adjustment of an attitude of the support structure within the trench;

a plurality of bollards, wherein each of the plurality of bollards have a lower portion positioned within a corresponding one of the plurality of sleeves;

wherein the support structure includes a lower support member attached to a lower portion of each of the plurality of sleeves, wherein the lower support member encloses a lower end of each of the plurality of sleeves;

wherein the lower support member is comprised of a length of channel iron, wherein the lower end of each of the plurality of sleeves is welded to the length of channel iron and positioned within a channel of the length of channel iron;

wherein the support structure includes an upper support member attached to an upper portion of each of the plurality of sleeves; and a volume of concrete within the trench and surrounding the support structure, wherein the upper opening for each of the plurality of sleeves is exposed through an upper surface of the volume of concrete.

18. A bollard wall system, comprising:

a support structure positioned at least partially within a trench of a ground surface, wherein the support structure includes a plurality of sleeves connected together, wherein each of the plurality of sleeves includes a lumen and an upper opening connected to the lumen, and wherein each of the plurality of sleeves are vertically orientated; and a plurality of bollards, wherein each of the plurality of bollards have a lower portion positioned within a corresponding one of the plurality of sleeves;

wherein the support structure includes a lower support member attached to a lower portion of each of the plurality of sleeves.

19. The bollard wall system of claim 18, wherein the plurality of sleeves are connected along a longitudinal axis.

20. The bollard wall system of claim 18, wherein each of the plurality of sleeves has a rectangular cross sectional area.

21. The bollard wall system of claim 18, wherein each of the plurality of sleeves are spaced apart equidistantly along a longitudinal axis.

22. The bollard wall system of claim 18, wherein the lower support member encloses a lower end of each of the plurality of sleeves.

23. The bollard wall system of claim 18, wherein the support structure includes an upper support member attached to an upper portion of each of the plurality of sleeves.

24. The bollard wall system of claim 18, wherein the plurality of sleeves are parallel to one another.

25. The bollard wall system of claim 18, wherein the plurality of sleeves are aligned with the upper opening of each of the plurality of sleeves positioned along a horizontal plane.

26. The bollard wall system of claim 18, wherein the plurality of sleeves are aligned with the upper opening of each of the plurality of sleeves positioned along an angled plane having an angle with respect to a horizontal plane.

27. The bollard wall system of claim 18, including a plurality of U-shaped rebar within the trench surrounding the support structure.

28. The bollard wall system of claim 18, including a plurality of adjustment members attached to the support structure, wherein the plurality of adjustment members extend downwardly below the support structure in an adjustable manner to allow for adjustment of an attitude of the support structure within the trench.

29. The bollard wall system of claim 28, wherein each of the plurality of adjustment members are comprised of a threaded member threadably connected to the support structure.

30. The bollard wall system of claim 18, including a first road and a second road on opposing sides of the plurality of bollards.

31. A bollard wall system, comprising:

a support structure positioned at least partially within a trench of a ground surface, wherein the support structure includes a plurality of sleeves connected together, wherein each of the plurality of sleeves includes a lumen and an upper opening connected to the lumen, and wherein each of the plurality of sleeves are vertically orientated; and a plurality of bollards, wherein each of the plurality of bollards have a lower portion positioned within a corresponding one of the plurality of sleeves;

wherein the plurality of sleeves are aligned with the upper opening of each of the plurality of sleeves positioned along an angled plane having an angle with respect to a horizontal plane.

32. The bollard wall system of claim 31, wherein the plurality of sleeves are connected along a longitudinal axis.

33. The bollard wall system of claim 31, wherein each of the plurality of sleeves has a rectangular cross sectional area.

34. The bollard wall system of claim 31, wherein each of the plurality of sleeves are spaced apart equidistantly along a longitudinal axis.

35. The bollard wall system of claim 31, wherein the support structure includes a lower support member attached to a lower portion of each of the plurality of sleeves and an upper support member attached to an upper portion of each of the plurality of sleeves.

36. The bollard wall system of claim 31, wherein the plurality of sleeves are parallel to one another.

37. The bollard wall system of claim 31, including a plurality of U-shaped rebar within the trench surrounding the support structure.

38. The bollard wall system of claim 31, including a plurality of adjustment members attached to the support structure, wherein the plurality of adjustment members extend downwardly below the support structure in an adjustable manner to allow for adjustment of an attitude of the support structure within the trench.

39. The bollard wall system of claim 38, wherein each of the plurality of adjustment members are comprised of a threaded member threadably connected to the support structure.

40. The bollard wall system of claim 31, including a first road and a second road on opposing sides of the plurality of bollards.

41. A bollard wall system, comprising:

a support structure positioned at least partially within a trench of a ground surface, wherein the support structure includes a plurality of sleeves connected together, wherein each of the plurality of sleeves includes a lumen and an upper opening connected to the lumen, and wherein each of the plurality of sleeves are vertically orientated;

a plurality of bollards, wherein each of the plurality of bollards have a lower portion positioned within a corresponding one of the plurality of sleeves; and a plurality of U-shaped rebar within the trench surrounding the support structure.

42. The bollard wall system of claim 41, wherein the plurality of sleeves are connected along a longitudinal axis.

43. The bollard wall system of claim 41, wherein each of the plurality of sleeves has a rectangular cross sectional area.

44. The bollard wall system of claim 41, wherein each of the plurality of sleeves are spaced apart equidistantly along a longitudinal axis.

45. The bollard wall system of claim 41, wherein the support structure includes a lower support member attached to a lower portion of each of the plurality of sleeves and an upper support member attached to an upper portion of each of the plurality of sleeves.

46. The bollard wall system of claim 41, wherein the plurality of sleeves are parallel to one another.

47. The bollard wall system of claim 41, including a plurality of adjustment members attached to the support structure, wherein the plurality of adjustment members extend downwardly below the support structure in an adjustable manner to allow for adjustment of an attitude of the support structure within the trench.

48. The bollard wall system of claim 47, wherein each of the plurality of adjustment members are comprised of a threaded member threadably connected to the support structure.

49. The bollard wall system of claim 41, including a first road and a second road on opposing sides of the plurality of bollards.

50. A bollard wall system, comprising:

a support structure positioned at least partially within a trench of a ground surface, wherein the support structure includes a plurality of sleeves connected together, wherein each of the plurality of sleeves includes a lumen and an upper opening connected to the lumen, and wherein each of the plurality of sleeves are vertically orientated;

a plurality of bollards, wherein each of the plurality of bollards have a lower portion positioned within a corresponding one of the plurality of sleeves; and a plurality of adjustment members attached to the support structure, wherein the plurality of adjustment members extend downwardly below the support structure in an adjustable manner to allow for adjustment of an attitude of the support structure within the trench.

51. The bollard wall system of claim 50, wherein the plurality of sleeves are connected along a longitudinal axis.

52. The bollard wall system of claim 50, wherein each of the plurality of sleeves has a rectangular cross sectional area.

53. The bollard wall system of claim 50, wherein each of the plurality of sleeves are spaced apart equidistantly along a longitudinal axis.

54. The bollard wall system of claim 50, wherein the support structure includes a lower support member attached to a lower portion of each of the plurality of sleeves and an upper support member attached to an upper portion of each of the plurality of sleeves.

55. The bollard wall system of claim 50, wherein the plurality of sleeves are parallel to one another.

56. The bollard wall system of claim 50, wherein each of the plurality of adjustment members are comprised of a threaded member threadably connected to the support structure.

57. The bollard wall system of claim 50, including a first road and a second road on opposing sides of the plurality of bollards.

58. A bollard wall system, comprising:

a support structure positioned at least partially within a trench of a ground surface, wherein the support structure includes a plurality of sleeves connected together, wherein each of the plurality of sleeves includes a lumen and an upper opening connected to the lumen, and wherein each of the plurality of sleeves are vertically orientated;

wherein the support structure includes a lower support member attached to a lower portion of each of the plurality of sleeves and an upper support member attached to an upper portion of each of the plurality of sleeves;

a plurality of U-shaped rebar within the trench surrounding the support structure;

a volume of concrete within the trench and surrounding the support structure, wherein the upper opening for each of the plurality of sleeves is exposed through an upper surface of the volume of concrete; and a plurality of bollards, wherein each of the plurality of bollards have a lower portion positioned within a corresponding one of the plurality of sleeves.

59. The bollard wall system of claim 58, wherein the plurality of sleeves are connected along a longitudinal axis.

60. The bollard wall system of claim 58, wherein each of the plurality of sleeves has a rectangular cross sectional area.

61. The bollard wall system of claim 58, wherein each of the plurality of sleeves are spaced apart equidistantly along a longitudinal axis.

62. The bollard wall system of claim 58, wherein the plurality of sleeves are parallel to one another.

63. The bollard wall system of claim 58, wherein the plurality of sleeves are aligned with the upper opening of each of the plurality of sleeves positioned along a horizontal plane.

64. The bollard wall system of claim 58, wherein the plurality of sleeves are aligned with the upper opening of each of the plurality of sleeves positioned along an angled plane having an angle with respect to a horizontal plane.

65. The bollard wall system of claim 58, including a first road and a second road on opposing sides of the plurality of bollards.

* * * * *